US007223127B2

(12) United States Patent
Ho

(10) Patent No.: US 7,223,127 B2
(45) **Date of Patent: *May 29, 2007**

(54) THIN USB ELECTRONIC DEVICE

(75) Inventor: Hsin-Chiang Ho, Taipei (TW)

(73) Assignee: Inventec Multimedia & Telecom Corporation, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/444,457

(22) Filed: Jun. 1, 2006

(65) Prior Publication Data

US 2006/0270281 A1 Nov. 30, 2006

Related U.S. Application Data

(63) Continuation-in-part of application No. 11/138,381, filed on May 27, 2005, now Pat. No. 7,090,541.

(51) Int. Cl.
*H01R 24/00* (2006.01)

(52) U.S. Cl. ..... 439/660; 439/76.1

(58) Field of Classification Search ..... 439/660, 439/76.1, 680

See application file for complete search history.

(56) References Cited

U.S. PATENT DOCUMENTS

| | | | | |
|---|---|---|---|---|
| 5,899,773 | A * | 5/1999 | Cheng | 439/680 |
| 5,993,263 | A * | 11/1999 | Sampson | 439/660 |
| 6,109,939 | A * | 8/2000 | Kondo et al. | 439/140 |
| 6,877,994 | B2 * | 4/2005 | Huang | 439/76.1 |
| 7,090,541 | B1 * | 8/2006 | Ho | 439/660 |
| 2005/0085133 | A1 * | 4/2005 | Wang et al. | 439/660 |

* cited by examiner

*Primary Examiner*—Tho D. Ta
(74) *Attorney, Agent, or Firm*—Birch, Stewart, Kolasch & Birch, LLP

(57) ABSTRACT

A thin USB electronic device, which includes a substrate and a housing enclosing the substrate, is disclosed. The substrate includes a circuit board and an extended connector. Electrically conductive metal strips are adhered to the connector, and integrated circuit elements are mounted on the substrate. The housing has openings, through which the corresponding metal strips are exposed and electrically communicate with the contacts of an USB receptacle. In another example USB electronic device, a plurality of metal film are used instead of electrically conductive strips, the integrated circuits are allocated centrally beneath the substrate, and bulges are manufactured upon the lower housing to sustain the extended connector.

18 Claims, 5 Drawing Sheets

THIN USB ELECTRONIC DEVICE

This application is a Continuation-In-Part of application Ser. No. 11/138,381 filed on May 27, 2005, now U.S. Pat. No. 7,090,541, the entire contents of which are hereby incorporated by reference and for which priority is claimed under 35 U.S.C. 120.

BACKGROUND OF THE INVENTION

1. Field of the Invention

The invention discloses a USB electronic device and specially relates to a thin USB electronic device.

2. Description of the Prior Art

With the progress in the information technology (IT) industry, portable electronic devices become more and more popular. Some of them, such as a flash drive or a small memory card, are capable of communicating with host (PC or notebook computer) through specific transmission interfaces, in which the universal serial bus (USB) is the most popular one. Because the USB is one of the most popular I/O interfaces in current personal computers, many electronic devices adopt USB as their transmission interface. The advantage of utilizing the USB is that it reduces the usage of a card reader for portable devices with different I/O interface.

Conventionally the connector for the USB electronic device is separated from the circuit board, and fabricated together by a weld. Because the USB connector's limitations, however, the USB electronic device will become too thick to be portable. Referring to FIG. 1, the housing 100 of the USB connector will influence and increase the volume and thickness of the electronic device. In order to reducing the thickness of all electronic elements among the electronic device as possible, the most regular solution is to improve the USB connector's structure, or to apply a connector-less design for thinning out the USB electronic device. Referring to FIG. 2A and FIG. 2B, Taiwan patent number 570242 discloses a USB storage device, therein the connector 202 is extended from the circuit board and enclosed in an upper housing 200 and a lower housing 201. By utilizing the contacts of a USB receptacle to touch the metal film 204 electroplated directly on the connector 202, the USB storage device could establish a circuit loop with the host. However, most parts of the connector 202 are exposed from the device housing, making the contacts (formed of metal films) short circuit easier by external matter, which decrease the electronic device's life.

FIG. 3 illustrates the simplified structure of a small USB connector disclosed in Taiwan patent number 565026, therein connector 30 and circuit board 31 are manufactured whole in one and placed in the lower housing 38. The upper housing 37 merely covers parts of the connector 30 and forms the device's housing with the lower housing 38. In addition, four metal strips 33 are adhered on the connector 30 as the contacts for communicating with an USB receptacle (not shown). However, the connector 30 still reveals too much to outside environment. Further, because it's necessary to drill on the connector 30 before adhering the metal strips 33, and a metal housing 39 shaped of U letter is also needed for protecting the connector 30, the structure of the USB electronic device becomes more complicated and harder to fabricate, resulting in difficulties in reducing production costs.

According to the above descriptions, the foregoing two inventions may achieve the goal for a thin USB electronic device, but there are still some disadvantages to overcome.

Therefore, there is need to further reduce the thickness of the USB connector and the thickness of the USB electronic device, to overcome the foregoing disadvantages, and provide more protection for the connector (especially contacts of USB electronic device).

SUMMARY OF THE INVENTION

As the shortcomings of conventional USB devices are discussed in the prior art, an objective of the invention is to provide a USB electronic device which having a thin structure.

A another objective of the invention is to provide an improved USB electronic device, in which the substrate and other electronic elements are substantially enclosed for preventing the connector and the contacts of the USB electronic device to become unnecessarily revealed, thereby gaining more protection.

A further objective of the invention is to provide an improved USB electronic device, in which every opening corresponds to a metal strip to make the improved USB electronic device functional for guiding each contact of an USB receptacle into the right position, and prevent mutual influences between the two metal strips or short circuit caused by external matter.

In accordance to the foregoing objectives of the invention a USB electronic device is disclosed, which comprises a substrate having a circuit board and a connector extending from the circuit board. Some metal strips adhere onto the connector, which is then electrically connected to the circuit board. At least one integrated circuit is mounted on the substrate, and a housing has openings, through which the corresponding metal strips are exposed and are electrically communicable with the contacts of a USB receptacle.

In another embodiment, the metal strips are replaced by metal film and the inner integrated circuit components are allocated centrally beneath the circuit board. Besides, a bulge section is formed upon the lower housing to sustain the substrate for increasing the structure's stability.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following detailed description and the accompanying drawings, which are given by why of illustration only, and thus are not limitative of the present invention, and in which.

DESCRIPTION OF THE PREFERRED EMBODIMENT

The preferred embodiment of the present invention is now described in great detail. Nevertheless, it should be recognized that the present invention can be practiced in a wide range of embodiments besides those explicitly described, and the scope of the present invention is expressly not limited except as specified in the accompanying claims.

Figure 1:
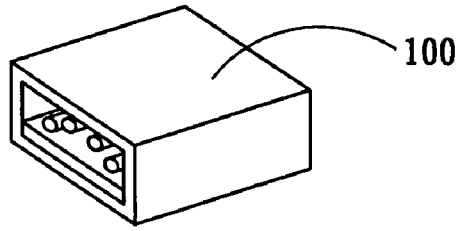
FIG. 1(Prior Art)
FIG. 1 illustrates a conventional USB connector.
Figure 2A:
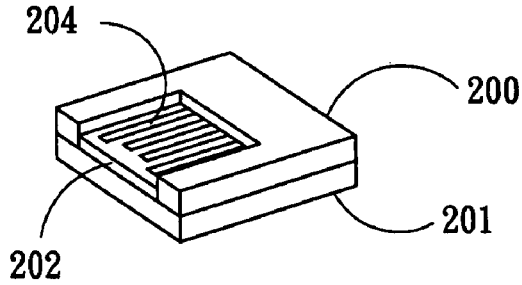
FIG. 2A(Prior Art)
FIG. 2A and FIG. 2B respectively illustrates a USB connector's structure of the prior art and its explosion drawing.
Figure 2B:
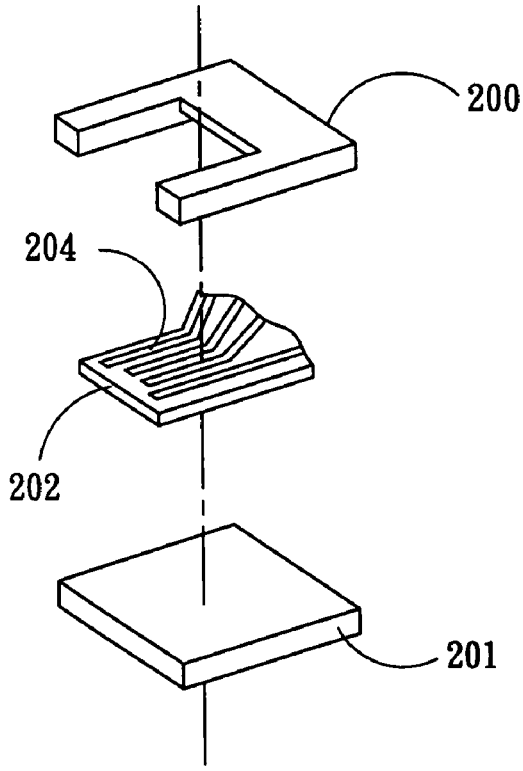
FIG. 2B(Prior Art)
Figure 3:
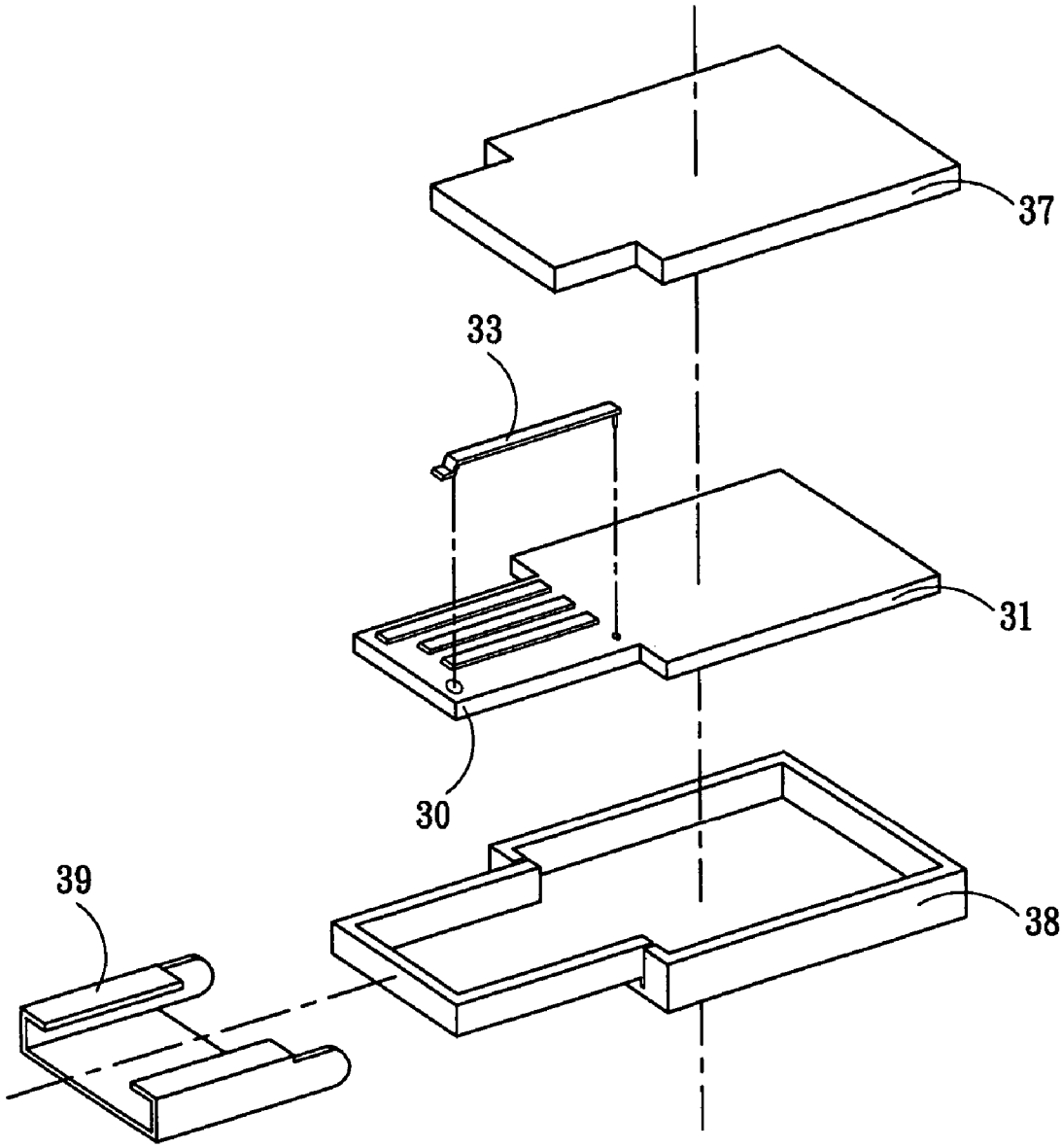
FIG. 3(Prior Art)
FIG. 3 illustrates the explosion drawing of a USB connector of another prior art.
Figure 4A:
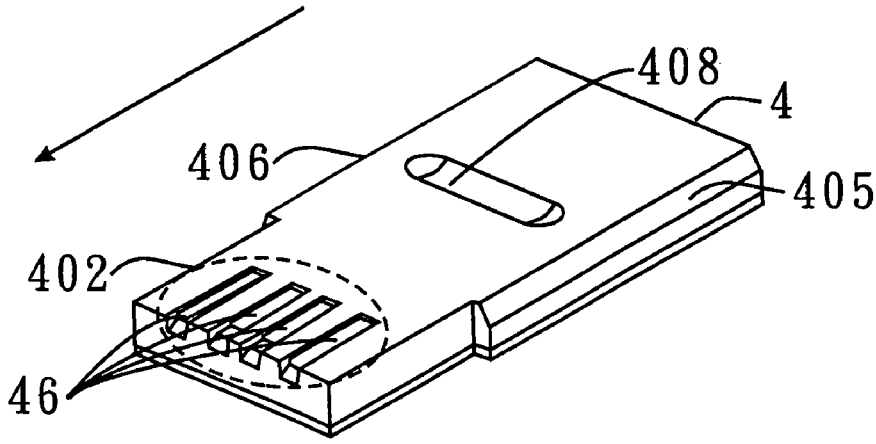
FIG. 4A is the preferred embodiment of the invention.

FIG. 4A illustrates a thin USB electronic device, which is the preferred embodiment of the invention, and specially the USB electronic device is an USB storage device. The arrow indicates the direction of the USB electronic device while inserting into an USB receptacle. The disclosed USB electronic device is enclosed with a housing 4, which opens some openings 402 (four in this embodiment) for exposing inner metal strips 46 as the contact for communicating with the USB receptacle of a host.

Figure 4B:
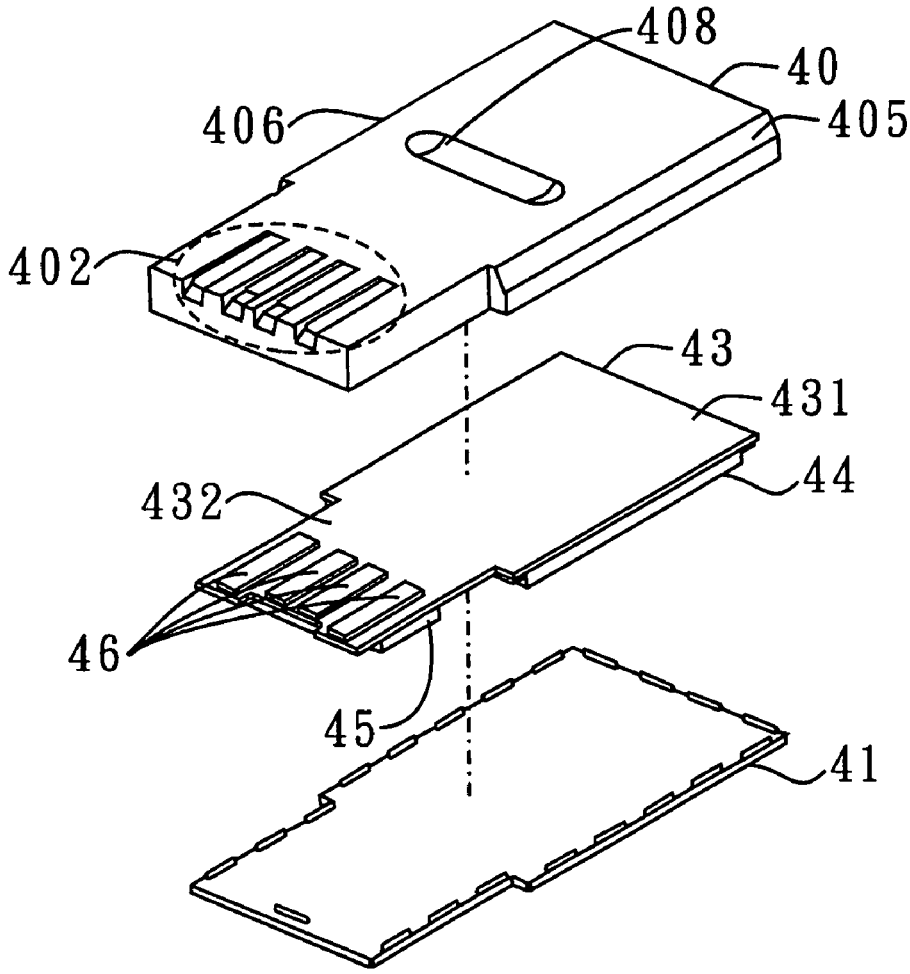
FIG. 4B is the explosion drawing of the preferred embodiment of the invention.

FIG. 4B is the explosion drawing of the preferred embodiment of the invention illustrating in FIG. 4A. Referring to FIG. 4B, the inner structure is distinctly revealed, therein every composing element of the USB electronic device are substantially enclosed in the upper housing 40 and lower housing 41. The composing elements include a substrate 43, which further comprises a circuit board 431 having an essential circuit layout, and a connector 432 extending from the circuit board 431. The preferred material of substrate 43 in this embodiment is a printed circuit board (PCB).

Metal strips 46, such as bronze strips, are adhered to a connector 432, and electrically connecting to the layout of circuit board 431. Means for fixing metal strip 46 on connector 432 are not limited, in which surface-mount technology (SMT) is preferred and applied in the embodiment. By reference to SMT, metal strips 46 directly adhere on connector 432 as the contacts for communicating with USB receptacle, advantaging of avoiding drilling on connector 432 which simplifies manufacture and reducing the costs.

A memory 44, such as a FLASH RAM, is mounted beneath substrate 43 for storing data. Besides, the bottom of substrate 43 further comprises a USB controller 45 for transforming an incoming USB signal into data and storing in the memory 44, or transforming the data stored in memory 44 into a USB signal to communicate with the host through metal strips 46.

It is noted that other elements except memory 44 and USB controller 45 could be mounted on the substrate 43. Furthermore, the memory 44 and USB controller 45 could be replaced by other type of integrated circuit. In other words, applications of the invention are not limited as a storage device, but applicable to the electronic devices of other purpose.

Figure 4C:
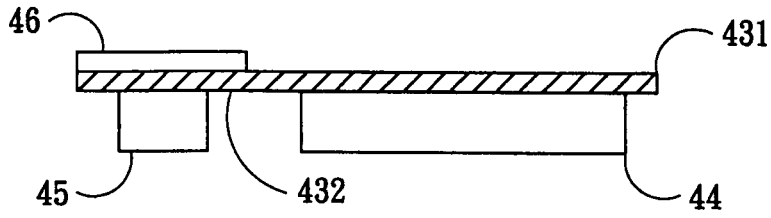
FIG. 4C is the side view for substrate of the preferred embodiment.

In order to achieve the goal for a thin USB electronic device, memory 44, USB controller 45, and metal strips 46 are designed as thin as possible. Besides, putting memory 44, USB controller 45, or other elements on the same side of substrate 43 (bottom in this embodiment) avoids increasing the thickness compared to putting them on both sides of the substrate 43. Hence, referring to FIG. 4C, in which memory 44 is mounted beneath the circuit board 431 and the USB controller 45 is mounted beneath the connector 432 for optimizing the usage of space.

In the preferred embodiment of the invention, openings 402 sets on the upper housing 40 are counted in four and strip-shaped, and certainly the width of each opening and the interval between two adjacent openings should be compatible with the USB standard. Through openings 402 only metal strips 46 are exposed from the upper housing 40. In other words, each metal strip corresponds to an opening and partially exposed part of the upper housing 40 as contacts for electrically communicating with the USB receptacle. Because the height of the metal strips 46 is lower than the surface of the upper housing 40, hence the thickness of the invention won't be increased, and a flatter structure for USB electronic devices will be achieved. In addition, the upper housing 40 near the front end of each openings 402 further forms a inclined plane which has the advantage of making the contacts of the USB receptacle more smooth to touch the metal strips 46.

Comparing to the prior arts, the major difference is that there are pluralities of openings opened on the device housing to merely expose the metal strips excluding the other areas of the connector. The particular structure design for the device housing benefits in many ways. First, because every exposed metal strip is separated from each other by the upper housing 40, it's more difficult to bring about short circuits between the two metal strips cause by external matter. Second, except for parts of metal strips 46, the other areas of the connector 432 are totally enclosed in the housing 4, hence it makes less of an exposed area of the connector of the invention than that of the prior art. Besides, the height of metal strips 46 are lower than the surface of the upper housing 40, therefore the USB connector is harder to be stressed by foreign matter and thus obtains more protection. Furthermore the upper housing 40 isolates each metal strip with a relative higher surface, guiding the contacts of the USB receptacle to the corresponding metal strip, which prevents more than one contacts of the USB receptacle erroneously touching the same metal strip.

Figure 4D:
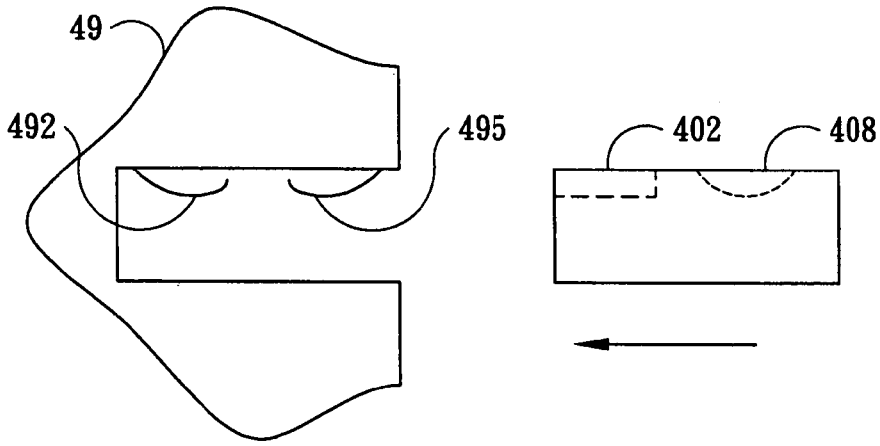
FIG. 4D shows the side view of the preferred embodiment of the invention and an USB receptacle.

In addition, housing 4 may make some variations to the design to achieve more functions, for example, the upper housing 40 may further form a hole 408. FIG. 4D shows the side view of the invention and the USB receptacle, in which the preferred embodiment of the invention is inserting into the USB receptacle from right to left. For USB receptacle 49 having a larger depth and inner volume, it's feasible to add a bolt 495 to lodge in hole 408. As the preferred embodiment of the invention inserting into USB receptacle 49, bolt 495 and contacts 492 slightly lift till the disclosed USB electronic device is in the right position. Among them through openings 402 contacts 492 touch the metal strips, and bolt 495 inserts in the hole 408 to fasten the electronic device, which achieves more robust connection with the USB receptacle 49.

Figure 4E:
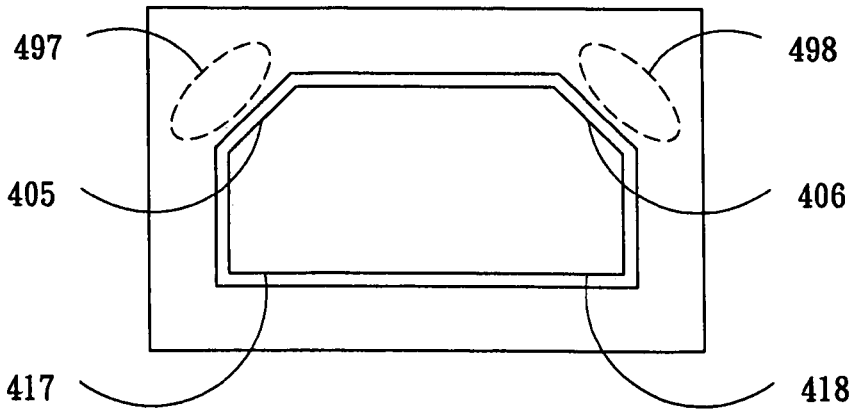
FIG. 4E shows the front view of the preferred embodiment of the invention and an USB receptacle.

Furthermore, flanks of housing 4 may form incline 405, 406 as shown in FIG. 4A, thereby resulting in asymmetry of the disclosed electronic device. For a USB receptacle shaped as shown in FIG. 4E, if the electronic device is overturned, the triangular corner 497, 498 will block the bottom sides of electronic device (417,418). It means the incline 405, 406 provides a foolproof mechanism that insures reverse insertion is denied. It's stressed that, the incline 405,406 is not only limited to form on the top flanks of the housing 4, but also the bottom, top and bottom of one flank, or only one incline 405 is permitted. With a compatible USB receptacle, the USB electronic device of the invention achieves a foolproof function. Besides, hole 408 and the incline 405, 406 are optional, the designer for the electronic device may decide by himself if applying the foregoing design is needed or not.

Figure 5A:
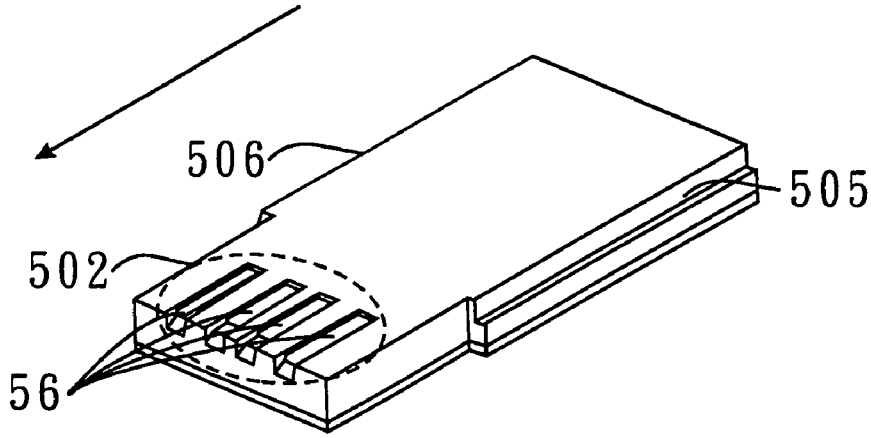
FIG. 5A illustrates an another embodiment of the present invention.
Figure 5B:
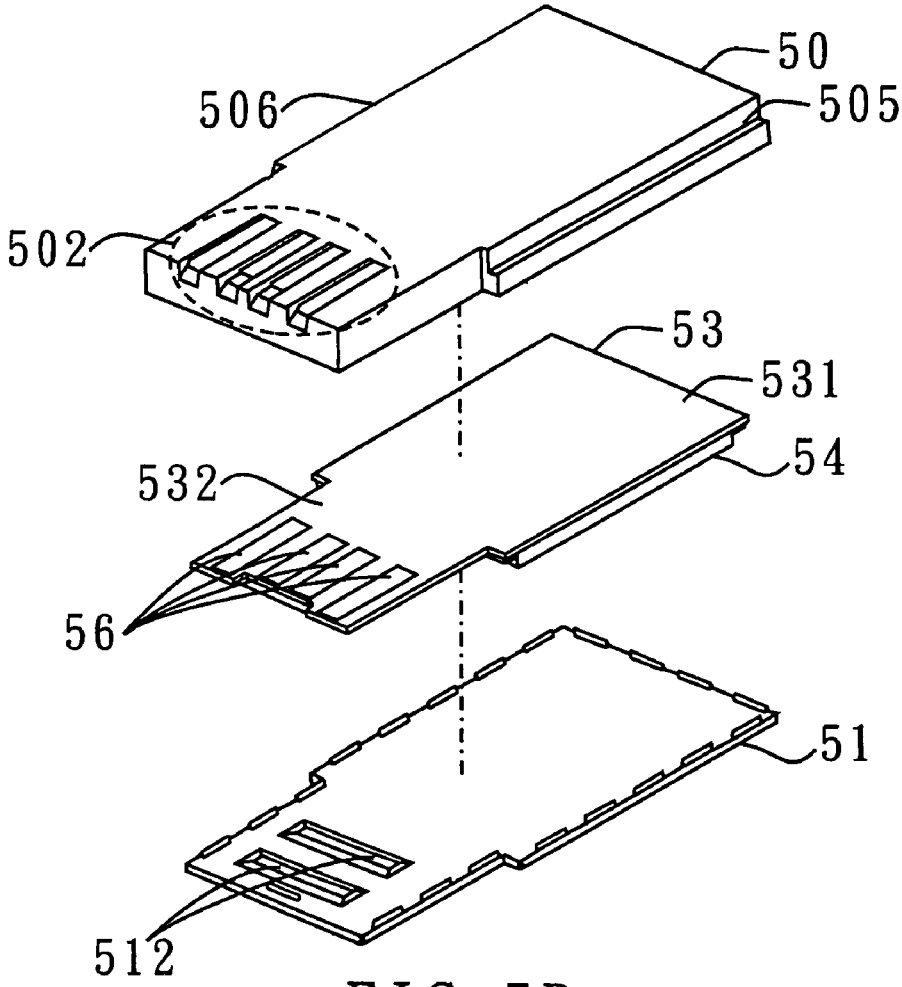
FIG. 5B illustrates the explosion drawing of the embodiment of FIG. 5A.

FIG. 5A depicts the appearance look for a thin USB electronic device with an another embodiment of the present invention, and FIG. 5B is the explosion drawing of FIG. 5A, which reveals the inner components and the structure of the USB electronic device. The original incline structure at the flanks of the housing are replaced with the various design (L-shaped structure 505 506) shown in FIG. 5A, and also provides foolproof mechanism. There are still four openings 502 placed upon the upper housing 50. Since the structure, shapes and functions of the four openings are the same to the previous embodiment, they will not be explained redundantly hereafter.

Similarly, the proposed electronic device may be divided into an upper housing 50, a lower housing 51 and the intermediate substrate 53. Also, the substrate 53 can be further divided into a circuit board 531 and an extended connector 532. The same to the previous embodiment, the preferred material for the substrate 43 is the print circuit board. In this embodiment, one side of the connector 532 has several contacts (golden fingers), which are formed of rectangular electronic conductive metal film perpendicular for each another, to communicate with the USB receptacle, and the another side is electrically communicated to the layout upon the circuit board 531. The substrate 53, especially beneath the circuit board 531, allocates several integrated circuit components, such as the memory 54 and the USB controller (not shown in the drawing), for storing inputted data.

The different points to the previous embodiment include, using metal film to form the contacts of USB electronic device and allocating most components centrally beneath the circuit board 531. One advantage of using metal film is the cheaper unit cost (compare to metal strip); besides, the metal film 56 may be manufactured as the same time as laying the transmission line upon the circuit board 531 (In other words, the metal film 56 may be extended directly from the layout of the circuit board 531), thereby simplifying the manufacturing process. Furthermore, to allocate both the memory 54 and the USB controller beneath the circuit board 531 may reduce length of the transmission line upon the circuit board, which also reduces the manufacturing cost.

However, the connector 532 is unsupported and suspended in the housing 5. Hence, in order to increase the structure's stability, a bulge section 512 is manufactured upon the inside face of the lower housing 51 to sustain the connector 532. Thickness of the bulge section 512 is about the same to the height of the memory device 54 (or the USB controller), and shapes or numbers of bulge section 512 are not limited to the present embodiment.

For the above descriptions, the disclosed invention achieves several advantages such as: achieving the major goal of the invention for a thin USB electronic device; the particular design for openings through which merely exposes the essential metal strips/film results in providing the connector and adhered contacts more protection than the prior art; and furthermore, the structure/shape of the housing may design optionally with a hole over the housing for fastening the USB electronic device, or forms at least one incline as a foolproof mechanism. In another embodiment of the present invention, the contacts and the position of the inner components of the present USB device varies to acquire different advantages. Hence, obviously the disclosed USB electronic device of the invention is superior to the prior art, and the invention is novel and progressive.

The above-mentioned are only the preferred embodiments of the present invention, not intended to limit the scope thereof. It will be appreciated and carried out by those professions skilled in the art. Thus, many modifications of the embodiments that can be made without departing from the spirit of the present invention should be covered by the following claims.

The invention claimed is:

1. A USB electronic device being insertable into a USB receptacle, comprising:

a substrate having a circuit board and a connector extending from the circuit board;

a plurality of metal strips adhering to the connector, ends of the metal strips being electrically connected to the circuit board;

at least one integrated circuit mounted on the substrate; and a housing, the housing having:

a hole arranged on a top surface thereof, and a plurality of openings, through which the corresponding metal strips are exposed and are electrically communicable with contacts of the USB receptacle.

2. The USB electronic device of claim 1, wherein the at least one integrated circuit is mounted on a same surface of the substrate, thereby reducing a thickness of the USB electronic device.

3. The USB electronic device of claim 1, wherein the substrate is substantially enclosed in the housing.

4. The USB electronic device of claim 1, wherein a width of each opening and an interval between adjacent openings are compatible with a USB standard.

5. The USB electronic device of claim 1, further comprising at least one incline formed on a top or bottom surface of both flanks of the housing.

6. The USB electronic device of claim 1, wherein the metal strips are mounted onto the substrate by surface mounting technology (SMT).

7. The USB electronic device of claim 1, wherein the at least one integrated circuit comprises a memory for storing data.

8. The USB electronic device of claim 7, wherein the at least one integrated circuit further comprises a USB controller for transforming the data of the memory into a USB signal compatible with a USB standard, or reversely transforming an incoming USB signal and then storing the transformed USB signal into the memory.

9. The USB electronic device of claim 8, wherein the USB controller establishes an electric loop with the memory.

10. The USB electronic device of claim 1, wherein the openings are arranged on a top surface of the housing and are extended forward to a front end of the housing.

11. The USB electronic device of claim 10, further comprising an inclined plane along the openings at the front end of the housing.

12. A USB electronic device being insertable into a USB receptacle, comprising:

a substrate having a circuit board and a connector extending from the circuit board;

a plurality of metal films adhering to the connector, wherein each metal film is positioned in parallel on the connector and is electrically connected to the circuit board;

at least one integrated circuit component mounted on a bottom surface of the substrate; and a housing, the housing containing an upper housing and a lower housing to enclose the substrate, wherein the upper housing has a plurality of openings, each opening corresponds to one metal film, and the plurality of metal films is exposed through the plurality of openings to form contacts of the USB electronic device, and wherein the lower housing has a bulge section touching the bottom surface of the substrate to sustain the connector.

13. The USB electronic device of claim 12, wherein the plurality of metal films extends directly from the circuit board.

14. The USB electronic device of claim 12, wherein the bulge section has a thickness about the same as a height of the integrated circuit component.

15. The USB electronic device of claim 12, wherein the integrated circuit component comprises a memory and a USB controller.

16. The USB electronic device of claim 12, wherein the integrated circuit component is allocated beneath the circuit board.

17. The USB electronic device of claim 12, wherein each of the openings near the front of the housing further forms an inclined plane.

18. The USB electronic device of claim 12, wherein the upper housing forms L-shaped structures upon the flank of the upper housing as a foolproof mechanism.

* * * * *